US007688284B2

(12) United States Patent
Kim et al.

(10) Patent No.: US 7,688,284 B2
(45) Date of Patent: Mar. 30, 2010

(54) METHOD OF DRIVING A PLASMA DISPLAY PANEL

(75) Inventors: Young Dae Kim, Busan (KR); Moon Shick Chung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1564 days.

(21) Appl. No.: 10/954,274

(22) Filed: Oct. 1, 2004

(65) Prior Publication Data

US 2005/0073481 A1 Apr. 7, 2005

(30) Foreign Application Priority Data

Oct. 6, 2003 (KR) ..... 10-2003-0069166

(51) Int. Cl.
*G09G 3/28* (2006.01)

(52) U.S. Cl. ..... 345/60; 345/63; 315/169.4

(58) Field of Classification Search ..... 345/37, 345/41, 60–70, 89, 690; 315/169.3–169.5
See application file for complete search history.

(56) References Cited

U.S. PATENT DOCUMENTS 5,903,381 A * 5/1999 Watanabe et al. ..... 359/254
6,310,588 B1 * 10/2001 Kawahara et al. ..... 345/63
6,456,302 B2 * 9/2002 Kawahara et al. ..... 345/693
6,791,515 B2 * 9/2004 Kawahaea et al. ..... 345/63
2001/0013844 A1 8/2001 Shigeta ..... 345/60

FOREIGN PATENT DOCUMENTS

EP 0 840 274 A1 5/1998
EP 0 893 916 A2 1/1999
EP 1 077 466 A2 2/2001
EP 1 182 635 2/2002
JP 2003-066901 3/2003

OTHER PUBLICATIONS

Korean Office Action dated May 19, 2005.
European Office Action dated Jul. 16, 2007.

* cited by examiner

*Primary Examiner*—Abbas I Abdulselam
(74) *Attorney, Agent, or Firm*—Ked & Associates LLP

(57) ABSTRACT

The present invention relates to a plasma display panel, and more particularly, to a method of driving a plasma display panel. According to an embodiment of the present invention, a method of driving a plasma display panel in which one frame comprises a plurality of sub-fields and which represent a gray level by making the sub-fields emitting light according to brightness weights allocated to the sub-fields, includes a step of implementing a specific gray level using a previous or next luminous pattern of the specific gray level in representing the specific gray level where none of the sub-fields of a one-step lower gray level are luminous. The method of driving a plasma display panel according to the present invention enables to prevent electric discharge failure and to stably display images on the PDP of high-density Xe.

24 Claims, 4 Drawing Sheets

Fig. 3

| Gray level \ Sub-field | SF1 | SF2 | SF3 | SF4 | SF5 | SF6 | SF7 | SF8 |
|---|---|---|---|---|---|---|---|---|
| 31 | O | O | O | O | O | X | X | X |
| Light | Λ | Λ | Λ | Λ | Λ | | | |

(a)

| Gray level \ Sub-field | SF1 | SF2 | SF3 | SF4 | SF5 | SF6 | SF7 | SF8 |
|---|---|---|---|---|---|---|---|---|
| 32 | X | X | X | X | X | O | X | X |
| Light | | | | | | Λ | | |

(b)

Fig. 4

| n−1 gray level | n gray level | Display gray level |
|---|---|---|
| 15 | 17 | 16 |

(a)

| n−1 gray level | n gray level | Display gray level |
|---|---|---|
| 127 | 129 | 128 |

(b)

METHOD OF DRIVING A PLASMA DISPLAY PANEL

This Nonprovisional application claims priority under 35 U.S.C. §119(a) on Patent Application No. 10-2003-0069166 filed in Korea on Oct. 6, 2003, the entire contents of which are hereby incorporated by reference.

BACKGROUND OF THE INVENTION

1. Field of the Invention

The present invention relates to a plasma display panel, and more particularly, to a method of driving a plasma display panel.

2. Description of the Background Art

Generally, a plasma display panel (hereinafter abbreviated PDP) displays an image including characters and graphics in a manner of exciting a fluorescent substance by a 147 nm UV-ray emitted from a mixed gas discharge of (He+Xe), (Ne+Xe), or (He+Ne+Xe). PDP provides an excellent quality of image due to the recent development of technology as well as can be provided with a slim size and wide-screen. Specifically, a 3-electrodes AC surface discharge type PDP lowers its voltage necessary for an electric discharge using wall charges accumulated on a surface and protects its electrodes from sputtering occurring on the electric discharge, thereby being advantageous in enabling a low voltage drive and long endurance.

FIG. 1 is a perspective diagram of a discharge cell of a 3-electrodes AC surface discharge type PDP according to a related art. Referring to FIG. 1, a discharge cell of a 3-electrodes AC surface discharge type PDP consists of a scan electrode 30Y and sustain electrode 30Z formed on an upper substrate 10 and an address electrode 20X formed on a lower substrate 18.

Each of the scan and sustain electrodes 30Y and 30Z has a line width smaller than that of a transparent electrode 12Y or 12Z and includes a metal bus electrode 13Y or 13Z. The transparent electrodes 12Y and 12Z are generally formed of indium tin oxide (ITO) on the upper substrate 10. The metal bus electrodes 13Y and 13Z are generally formed of metal such as Cr or the like on the transparent electrodes 12Y and 12Z to reduce the voltage drops caused by the transparent electrodes 12Y and 12Z of high resistance, respectively. An upper dielectric layer 14 and protecting layer 16 are stacked over the upper substrate 10 including the scan and sustain electrodes 30Y and 30Z. Wall charges generated from plasma discharge are accumulated on the upper dielectric layer 14. The protecting layer 16 protects the upper dielectric layer 14 against sputtering caused by plasma discharge and increases discharge efficiency of secondary electrons. And, the protecting layer 16 is generally formed of MgO.

The address electrode 20X is formed in a direction crossing with that of the scan or sustain electrode 30Y or 30Z. A lower dielectric layer 22 and barrier rib 24 are formed on the lower substrate 8, having the address electrode 20X formed thereon. A fluorescent layer 26 is formed on surfaces of the lower dielectric layer 22 and the barrier rib 24. The barrier rib 24 is formed parallel to the address electrode 20Z to physically partition each discharge cell and prevents UV and visible rays generated from electric discharge from leaking to neighbor discharge cells. The fluorescent layer 26 is excited by the UV-ray generated from plasma discharge to emit light including one of red, green, and blue visible rays. A mixed inert gas such as He+Xe, Ne+Xe, He+Xe+Ne, and the like for electric discharge is injected in a discharge space of the discharge cell provided between the barrier ribs 24 and the upper and lower substrates 10 and 18.

In the above-configured 3-electrodes AC surface discharge type PDP, one frame is divided into several sub-fields differing in luminous times to implement gray levels. And, each of the sub-fields is divided again into a reset period for arousing electric discharge evenly, an address period for selecting a discharge cell, and a sustain period for implementing gray levels according to a discharging number.

For instance, in case of displaying an image at 256 gray levels, a frame period (16.67ms) corresponding to 1/60 second is divided into eight sub-fields SF1 To SF8. And, each of the eight sub-fields SF1 to SF8 is divided into a reset period, an address period, and a sustain period. The reset and address periods of the respective sub-fields are equal to each other, whereas the sustain periods and their discharge numbers of the respective sub-fields increase at a ratio of $2^n$ (n=0, 1, 2, 3, 4, 5, 6, 7), respectively. As the sustain period varies according to the corresponding sub-field, the image gray levels can be implemented.

Substantially, the sub-fields of the frame are selected to implement the gray levels in a manner of Table 1.

TABLE 1

| | SF1 Y1 | SF2 Y2 | SF3 Y3 | SF4 Y8 | SF5 Y16 | SF6 Y32 | SF7 Y64 | SF8 Y128 |
|---|---|---|---|---|---|---|---|---|
| 0 | X | X | X | X | X | X | X | X |
| 1 | ○ | X | X | X | X | X | X | X |
| 2 | X | ○ | X | X | X | X | X | X |
| 15 | ○ | ○ | ○ | ○ | X | X | X | X |
| 16 | X | X | X | X | ○ | X | X | X |
| 17 | ○ | X | X | X | ○ | X | X | X |
| 31 | ○ | ○ | ○ | ○ | ○ | X | X | X |
| 32 | X | X | X | X | X | ○ | X | X |
| 33 | ○ | X | X | X | X | ○ | X | X |
| 63 | ○ | ○ | ○ | ○ | ○ | ○ | X | X |
| 64 | X | X | X | X | X | X | ○ | X |
| 127 | ○ | ○ | ○ | ○ | ○ | ○ | ○ | X |
| 128 | X | X | X | X | X | X | X | ○ |
| 255 | ○ | ○ | ○ | ○ | ○ | ○ | ○ | ○ |

In Table 1, 'SFx' means an xth sub-field, 'Yz' indicates a brightness weight set to a decimal number for the corresponding sub-field, 'O ' indicates a turned-on state of the corresponding sub-field, and 'x' indicates a turned-off state of the corresponding sub-field.

The sub-fields, as shown in Table 1, bring about sustain discharges to correspond to the brightness weights allocated to them, respectively, thereby representing gray levels corresponding to the brightness weights, respectively. Yet, in the related art sub-field driving method, a discharge error may occur in the gray levels 15-16, 31-32, 63-64, and 127-128 where luminous patterns are varied more considerably than those of the previous gray levels, respectively. Moreover, in the gray levels 15-16, 31-32, 63-64, and 127-128 where luminous patterns are greatly varied, it is difficult to control wall charges.

Specifically, in order to represent the gray level of '31', the sustain discharge occurs in the first to fifth sub-fields SF1 to SF5. In doing so, since a plurality of the sub-fields are selected from one frame to represent the gray level of '31', the address discharge can occur stably in the selected sub-fields. In other words, the address discharge occurring in the fifth sub-field SF5 can take place stably due to the priming discharged particles produced from the previous sub-fields.

In order to represent the gray level of '32', the sustain discharge takes place in the sixth sub-field SF6. In doing so, one sub-field is selected from one frame to represent the gray level of '32'. In other words, the address discharge occurring in the sixth sub-field SF6 should take place without the aid of charged particles produced from the previous sub-field. For such a reason, it is highly probable that the address discharge may fail in the sixth sub-field SF6.

Meanwhile, in another related art, 10% Ne—Xe at 46 kPa is set as the discharge gas sealed within the PDP to increase density of the Xe component. Thus, even if a drive voltage of the high-density Xe panel becomes higher than that of the related art low-density Xe panel, brightness can be enhanced. Hence, the high-density Xe panel enables to display an image of high brightness by raising the Xe component of the discharge gas. Yet, since the drive voltage of the high-density Xe panel is set higher than that of the low-density Xe panel, it becomes more probable that the discharge failure of the high-density Xe panel may occur in the gray levels of 15-16, 31-32, 63-64, and 127-128 of which luminous patterns are varied more considerably than those of the previous gray levels, respectively.

SUMMARY OF THE INVENTION

Accordingly, an object of the present invention is to solve at least the problems and disadvantages of the background art.

An object of the present invention is to provide a method of diving a plasma display panel, by which electric discharge failure can be prevented.

According to an embodiment of the present invention, a method of driving a plasma display panel in which one frame comprises a plurality of sub-fields and which represent a gray level by making the sub-fields emitting light according to brightness weights allocated to the sub-fields, includes a step of implementing a specific gray level using a previous or next luminous pattern of the specific gray level in representing the specific gray level where none of the sub-fields of a one-step lower gray level are luminous.

According to an embodiment of the present invention, a method of driving a plasma display panel in which one frame comprises a plurality of sub-fields and which represent a gray level by making the sub-fields emitting light according to brightness weights allocated to the sub-fields, includes a step of implementing a specific gray level using a luminous pattern of a very previous gray level at an $(n-1)^{th}$ frame or a luminous pattern of a very next gray level at an $n^{th}$ frame in representing the specific gray level that none of the sub-fields of a one-step lower gray level are luminous.

The method of driving a plasma display panel according to the present invention enables to prevent electric discharge failure and to stably display images on the PDP of high-density Xe.

BRIEF DESCRIPTION OF THE DRAWINGS

The invention will be described in detail with reference to the following drawings in which like numerals refer to like elements.

FIG. 3 is a diagram of a luminous pattern of a sub-field corresponding to a brightness weight.

FIG. 4 is a diagram of explaining a method of representing a mean gray level using two frames.

DETAILED DESCRIPTION OF PREFERRED EMBODIMENTS

Figure 1:
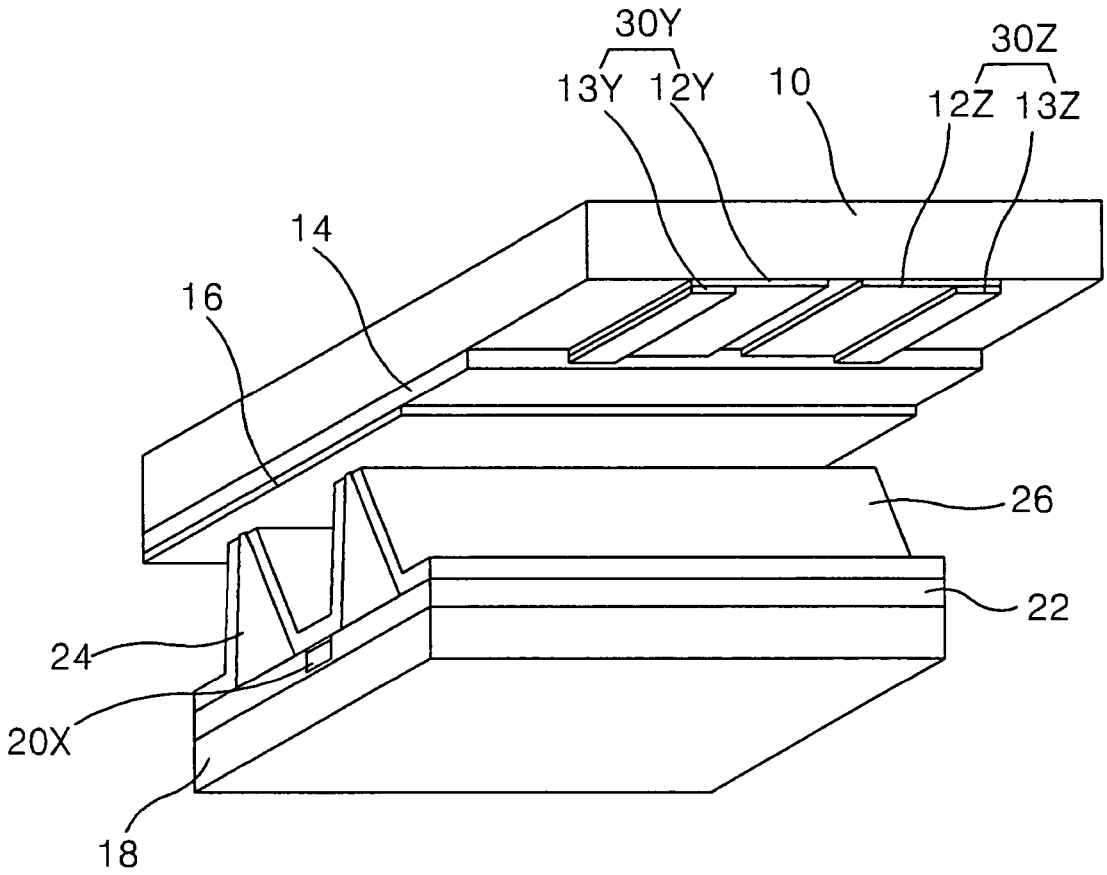
FIG. 1 is a perspective diagram of a discharge cell of a 3-electrodes AC surface discharge type PDP according to a related art.
Figure 2:
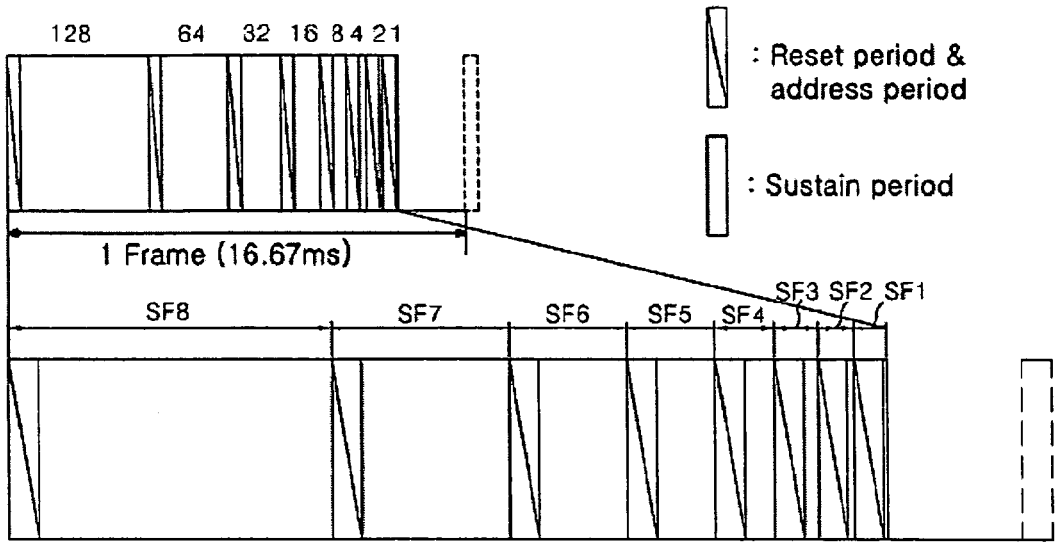
FIG. 2 is a timing diagram of one frame in a general plasma display panel.

Preferred embodiments of the present invention will be described in a more detailed manner with reference to the drawings.

According to an embodiment of the present invention, a method of driving a plasma display panel in which one frame comprises a plurality of sub-fields and which represent a gray level by making the sub-fields emitting light according to brightness weights allocated to the sub-fields, includes a step of implementing a specific gray level using a previous or next luminous pattern of the specific gray level in representing the specific gray level where none of the sub-fields of a one-step lower gray level are luminous.

The specific gray level is the gray level where the sub-field located behind at least a fourth sub-field of the frame becomes luminous independently.

The sub-field having the brightness weight of '1' is located at a third sub-field.

The specific gray level is the gray level that the sub-field located behind at least a fifth sub-field of the frame becomes luminous independently.

The sub-field having the brightness weight of '1' is located at either a third sub-field or a fourth sub-field.

A discharge gas including at least a 10% Xe gas is included in the plasma display panel.

The previous luminous pattern is a luminous pattern of a very previous gray level right before the specific gray level.

The next luminous pattern is a luminous pattern of a very next gray level right behind the specific gray level.

According to an embodiment of the present invention, a method of driving a plasma display panel in which one frame comprises a plurality of sub-fields and which represent a gray level by making the sub-fields emitting light according to brightness weights allocated to the sub-fields, includes a step of implementing a specific gray level using a luminous pattern of a very previous gray level at an $(n-1)^{th}$ frame or a luminous pattern of a very next gray level at an $n^{th}$ frame in representing the specific gray level that none of the sub-fields of a one-step lower gray level are luminous.

The specific gray level is the gray level where the sub-field located behind at least a fourth sub-field of the frame becomes luminous independently.

The sub-field having the brightness weight of '1' is located at a third sub-field.

The specific gray level is the gray level that the sub-field located behind at least a fifth sub-field of the frame becomes luminous independently.

The sub-field having the brightness weight of '1' is located at either a third sub-field or a fourth sub-field.

A discharge gas including at least a 10% Xe gas is included in the plasma display panel.

Hereafter, the embodiments of the present invention will be described with reference to the drawings.

First of all, in a method of driving a plasma display panel according to the present invention, one frame is divided into a plurality of sub-fields to be driven. For instance, in case of displaying an image with 256 gray levels, one is divided into eight sub-fields SF1 to SF8. And, each of the eight sub-fields has a separate brightness weight to represent the gray level.

Substantially, the sub-fields of the frame are selected to implement the gray levels in a manner of Table 1.

TABLE 2

| | SF1 Y1 | SF2 Y2 | SF3 Y3 | SF4 Y8 | SF5 Y16 | SF6 Y32 | SF7 Y64 | SF8 Y128 |
|---|---|---|---|---|---|---|---|---|
| 0 | X | X | X | X | X | X | X | X |
| 1 | ○ | X | X | X | X | X | X | X |
| 2 | X | ○ | X | X | X | X | X | X |
| 15 | ○ | ○ | ○ | ○ | X | X | X | X |
| 16 | ○ | ○ | ○ | ○ | X | X | X | X |
| 17 | ○ | X | X | X | ○ | X | X | X |
| 31 | ○ | ○ | ○ | ○ | ○ | X | X | X |
| 32 | ○ | ○ | ○ | ○ | ○ | X | X | X |
| 33 | ○ | X | X | X | X | ○ | X | X |
| 63 | ○ | ○ | ○ | ○ | ○ | ○ | X | X |
| 64 | ○ | ○ | ○ | ○ | ○ | ○ | X | X |
| 127 | ○ | ○ | ○ | ○ | ○ | ○ | ○ | X |
| 128 | ○ | ○ | ○ | ○ | ○ | ○ | ○ | X |
| 255 | ○ | ○ | ○ | ○ | ○ | ○ | ○ | ○ |

In Table 3, 'SFx' means an xth sub-field, 'Yz' indicates a brightness weight set to a decimal number for the corresponding sub-field, 'O' indicates a turned-on state of the corresponding sub-field, and 'x' indicates a turned-off state of the corresponding sub-field.

The sub-fields of the present invention, as shown in Table 2, bring about sustain discharges to correspond to the brightness weights allocated to them, respectively, thereby representing gray levels corresponding to the brightness weights, respectively. In the sub-field driving method of the present invention, a luminous pattern of the previous gray level is maintained at a specific gray level (16, 32, 64, 128) of which luminous pattern needs to be varied more greatly than that of the very previous gray level. In this case, the specific gray level of which luminous pattern needs to be varied more greatly means the gray level before which the entire sub-fields of the previous gray level fail to be luminous. In other words, the first to fourth sub-fields SF1 to SF4 become luminous at the gray level of '15'. Yet, the fifth sub-field SF5 becomes luminous at the specific gray level of '16' only.

Specifically, since the fifth sub-field SF5 should be luminous only to represent the gray level of '16', there occurs no sustain discharge in the sub-field prior to the fifth sub-field SF5 so that the discharge failure may take place. Yet, by representing the gray level of '16' using the same luminous pattern of the gray level of '15', the present invention enables to prevent the discharge failure from occurring in representing the gray level of '16'. Namely, when the sub-field following the fifth or fourth sub-field of the frame is independently becomes luminous to correspond to a specific brightness weight, the gray level of a specific brightness weight is represented using the luminous pattern of the previous gray level. Hence, the present invention enables to prevent the discharge failure.

For another instance, the eighth sub-field SF8 should be luminous only to corresponding to a brightness weight in representing the gray level of '128'. Since the eighth sub-field SF8 located behind at least the fifth or fourth sub-field of the frame should be independently luminous in representing the gray level of '128', the present invention represents the gray level using the luminous pattern of the gray level of '127'. In other words, the present invention enables to prevent the discharge failure from occurring in representing the gray level of '128' using the luminous pattern of the gray level of '127'.

Thus, if the driving method according to the present invention is applied to the high-density Xe (over 10%), the PDP can be stably driven without the discharge failure despite the drive voltage increase.

Besides, the present invention selects sub-fields in a manner of Table 3 to represent the gray levels.

TABLE 3

| | SF1 Y1 | SF2 Y2 | SF3 Y3 | SF4 Y8 | SF5 Y16 | SF6 Y32 | SF7 Y64 | SF8 Y128 |
|---|---|---|---|---|---|---|---|---|
| 0 | X | X | X | X | X | X | X | X |
| 1 | ○ | X | X | X | X | X | X | X |
| 2 | X | ○ | X | X | X | X | X | X |
| 15 | ○ | ○ | ○ | ○ | X | X | X | X |
| 16 | ○ | X | X | X | ○ | X | X | X |
| 17 | ○ | X | X | X | ○ | X | X | X |
| 31 | ○ | ○ | ○ | ○ | ○ | X | X | X |
| 32 | ○ | X | X | X | X | ○ | X | X |
| 33 | ○ | X | X | X | X | ○ | X | X |
| 63 | ○ | ○ | ○ | ○ | ○ | ○ | X | X |
| 64 | ○ | X | X | X | X | X | ○ | X |
| 127 | ○ | ○ | ○ | ○ | ○ | ○ | ○ | X |
| 128 | ○ | X | X | X | X | X | X | ○ |
| 255 | ○ | ○ | ○ | ○ | ○ | ○ | ○ | ○ |

In Table 3, 'SFx' means an xth sub-field, 'Yz' indicates a brightness weight set to a decimal number for the corresponding sub-field, 'O' incidates a turned-on state of the corresponding sub-field, and 'x' indicates a turned-off state of the corresponding sub-field.

The sub-fields of the present invention, as shown in Table 3, bring about sustain discharges to correspond to the brightness weights allocated to them, respectively, thereby representing gray levels corresponding to the brightness weights, respectively. In the sub-field driving method of the present invention, a luminous pattern of the very next gray level is maintained at a specific gray level (16, 32, 64, 128) of which luminous pattern needs to be varied more greatly than that of the very previous gray level. In this case, the specific gray level of which luminous pattern needs to be varied more greatly means the gray level before which the entire sub-fields of the previous gray level fail to be luminous. In other words, the first to fourth sub-fields SF1 to SF4 become luminous at the gray level of '15'. Yet, the fifth sub-field SF5 becomes luminous at the specific gray level of '16' only.

Specifically, since the fifth sub-field SF5 should be luminous only to represent the gray level of '16', there occurs no sustain discharge in the sub-field prior to the fifth sub-field SF5 so that the discharge failure may take place. Yet, by representing the gray level of '16' using the same luminous pattern of the gray level of '17', the present invention enables to prevent the discharge failure from occurring in representing the gray level of '16'. Namely, when the sub-field following the fifth or fourth sub-field of the frame is independently becomes luminous to correspond to a specific brightness weight, the gray level of a specific brightness weight is represented using the luminous pattern of the very next gray level. Hence, the present invention enables to prevent the discharge failure.

For another instance, the eighth sub-field SF8 should be luminous only to corresponding to a brightness weight in representing the gray level of '128'. Namely, since the eighth sub-field SF8 located after at least the fifth or fourth sub-field of the frame should be independently luminous in representing the gray level of '128', the present invention represents the gray level using the luminous pattern of the gray level of '129'. In other words, the present invention enables to prevent the discharge failure from occurring in representing the gray level of '128' using the luminous pattern of the gray level of '129'.

Thus, if the driving method according to the present invention is applied to the high-density Xe (over 10%), the PDP can be stably driven without the discharge failure despite the drive voltage increase.

Besides, the present invention enables to arrange sub-field luminous patterns in a manner of Table 4 to bring about the electric discharge more stably.

TABLE 4

| SF1 | SF2 | SF3 | SF4 | SF5 | SF6 | SF7 | SF8 |
|---|---|---|---|---|---|---|---|
| Y2 | Y3 | Y8 | Y1 | Y16 | Y32 | Y64 | Y128 |

In Table 4, 'SFx' means an $x^{th}$ sub-field and 'Yz' indicates a brightness weight set to a decimal number for the corresponding sub-field.

Referring to Table 4, by arranging the sub-field representing the gray level of '1' in the middle of the frame, it is able to bring about the electric discharge more stably in representing the gray level in the manner of Table 3. In other words, by arranging the sub-field representing the gray level of '1' in the fourth field SF4 prior to a first specific gray level, e.g., '16', of which luminous pattern needs to be greatly varied in the frame, it is able to bring about the discharge more stably. Namely, by arranging the sub-field representing the gray level of '1', which becomes most frequently luminous in probability, in the fourth sub-field, it is able to utilize the priming effect more efficiently. Substantially, in case of representing the gray level of '128' in the manner of Table 3, the first and eighth sub-fields SF1 and SF8 are selected from Table 3. Since there exists a great timing interval between the first and eighth sub-fields SF1 and SF8, it is probable that the discharge failure may occur. Yet, if the gray level of '1' is arranged in the fourth sub-field like Table 4, the fourth and eighth sub-fields SF4 and SF8 are selected in case of representing the gray level of '128' in the manner of Table 3. Hence, the discharge failure can be prevented.

For convenience of explanation of the present invention, the frame having the luminous patterns of 1, 2, 4, 8, 16, 32, 64, and 128 are taken as a reference. Yet, the present invention is applicable to PDP having various luminous patterns. For instance, the present invention is applicable to the frame having the luminous patterns of 1, 2, 4, 8, 16, 32, 64, 64, 64, and 64. In this case, the sub-field having the luminous pattern of '1' can be arranged in the fourth sub-field.

Meanwhile, mean brightness of a specific gray level, as shown in FIG. 4A and FIG. 4B, can be represented. Specifically, in order to represent the gray level of '16', an average is taken of the gray level for an $(n-1)^{th}$ gray level (e.g., the $15^{th}$ gray level), where n is a natural number, and the gray level of an $n^{th}$ gray level (e.g., $17^{th}$ gray level). In doing so, a user recognizes an image displayed on a panel by the gray level of '16' as the mean gray level between the $(n-1)^{th}$ and $n^{th}$ levels. Likewise, in order to represent the gray level of '128', the gray level of '128' can be represented on the average in a manner of representing the gray level of '127' and of '129'.

As mentioned in the foregoing description, a method of driving a plasma display panel according to the present invention represents the gray level using the luminous pattern of the very previous or next gray level centering on the gray level of which gray pattern is varied more greatly than that of the previous gray level, thereby enabling to prevent the discharge failure. Specifically, the present invention is applied to the PDP including the discharge gas of high-density Xe, thereby enabling to display the image more stably on the PDP of the high-density Xe. Moreover, the present invention arranges the sub-field having the gray level of '1' in the middle of the frame, thereby enabling to efficiently utilize the priming effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a plasma display panel in which one frame comprises a plurality of sub-fields that cause a gray level of light to be emitted according to brightness weights allocated to the sub-fields, wherein the method includes:

implementing a specific gray level using a same luminous pattern that corresponds to a previous or next gray level relative to the specific gray level, wherein the luminous pattern for the previous gray level has an on-state value for a first set of consecutive sub-fields beginning with a first sub-field and has an off-state value for a second set of consecutive sub-fields following the first set of sub-fields, wherein the luminous pattern for the next gray level has an on-state value for a set of non-consecutive sub-fields and an off-state value for all remaining sub-fields, and wherein the previous gray level is a gray level that comes before the specific gray level and the next gray level is a gray level that comes after the specific gray level.

2. The method of claim 1, wherein a predetermined one of the plurality of sub-fields has a brightness weight of '1'.

3. The method of claim 2, wherein the predetermined one of the plurality of sub-fields having a brightness weight of '1' is a sub-field other than the first sub-field or a last one of the sub-fields in the frame.

4. The method of claim 1, wherein a discharge gas including at least a 10% Xe gas is included in the plasma display panel.

5. The method of claim 1, wherein the previous gray level is immediately adjacent to the specific gray level.

6. The method of claim 1, wherein the next gray level is immediately adjacent the specific gray level.

7. The method of claim 1, wherein the previous gray level is a gray level that comes immediately before the specific gray level and the next gray level is a gray level that comes immediately after the specific gray level.

8. The method of claim 1, wherein the luminous patterns for all gray levels except the luminous pattern for the specific gray level and the luminous pattern for the previous gray level or next gray level that is the same as the luminous pattern for the specific gray level are different from one another.

9. A method of driving a plasma display panel in which one frame comprises a plurality of sub-fields that cause a gray level of light to be emitted according to brightness weights allocated to the sub-fields, wherein the method includes:

implementing a specific gray level using a same luminous pattern that corresponds to a previous or next gray level relative to the specific gray level, wherein the luminous pattern for the previous gray level has an on-state value for a first set of consecutive sub-fields beginning with a first sub-field and has an off-state value for a second set of consecutive sub-fields following the first set of sub-fields, wherein the luminous pattern for the next gray level has an on-state for two non-consecutive subfields and has an off-state value for all remaining sub-fields, and wherein the previous gray level is a gray level that comes before the specific gray level and the next gray level is a gray level that comes after the specific gray level.

10. The method of claim 9, wherein a predetermined one of the plurality of sub-fields has a brightness weight of '1'.

11. The method of claim 9, wherein the previous gray level is a gray level that comes immediately before the specific gray level and the next gray level is a gray level that comes immediately after the specific gray level.

12. A method of driving a plasma display panel in which one frame comprises a plurality of sub-fields that cause a gray level of light to be emitted according to brightness weights allocated to the sub-fields, wherein the method includes:

representing a specific gray level based on a mean gray level of two sub-frames, said mean gray level corresponding to an average of a luminous pattern of a gray level that immediately precedes the specific gray level and a luminous pattern of a gray level that immediately succeeds the specific gray level, wherein the luminous pattern for the immediately succeeding gray level has an on-state for two non-consecutive subfields and has an off-state value for all remaining sub-fields.

13. The method of claim 12, wherein the luminous pattern of the gray level that immediately precedes the specific gray level has an on-state value for a first set of consecutive sub-fields beginning with a first sub-field and has an off-state value for a second set of consecutive sub-fields following the first set of sub-fields.

14. The method of claim 13, wherein a predetermined one of the plurality of sub-fields has a brightness weight of '1'.

15. The method of claim 14, wherein the predetermined one of the plurality of sub-fields having a brightness weight of '1' is a sub-field other than the first sub-field or a last one of the sub-fields in the frame.

16. The method of claim 12, wherein a predetermined one of the plurality of subfields has a brightness weight of '1'.

17. The method of claim 12, wherein a discharge gas including at least a 10% Xe gas is included in the plasma display panel.

18. The method of claim 16, wherein the predetermined one of the plurality of sub-fields having a brightness weight of '1' is a sub-field other than the first sub-field or a last one of the sub-fields in the frame.

19. A method of driving a plasma display panel in which one frame comprises a plurality of sub-fields that cause a gray level of light to be emitted according to brightness weights allocated to the sub-fields, wherein the method includes:

representing a specific gray level based on a mean gray level, said mean gray level corresponding to an average of a luminous pattern of a gray level that precedes the specific gray level and a luminous pattern of a gray level that succeeds the specific gray level, wherein the luminous pattern of the gray level that precedes the specific gray level has a first value for a first set of consecutive sub-fields beginning with a first sub-field and has a second value for a second set of consecutive sub-fields following the first set of sub-fields, and wherein the luminous pattern for the succeeding gray level has a first value for two non-consecutive subfields and a second value for all remaining sub-fields.

20. The method of claim 19, wherein the first value is an on-state value and the second value is an off-state value.

21. The method of claim 19, wherein the first value is an on-state value and the second value is an off-state value.

22. A method of driving a plasma display panel in which one frame comprises a plurality of sub-fields that cause a gray level of light to be emitted according to brightness weights allocated to the sub-fields, wherein the method includes:

implementing a specific gray level using a same luminous pattern that corresponds to a previous or next gray level relative to the specific gray level, wherein the specific gray level is implemented by setting all the sub-fields in the frame to same values as set for the same sub-fields used to implement the previous or next gray level, said values including an on-state value and an off-state value, wherein the previous gray level is a gray level that comes before the specific gray level and the next gray level is a gray level that comes after the specific gray level, and wherein the luminous pattern for the next gray level has an on-state for two non-consecutive subfields and has an off-state value for all remaining sub-fields.

23. The method of claim 22, wherein the luminous pattern for the previous gray level has an on-state value for a first set of consecutive sub-fields beginning with a first sub-field and has an off-state value for a second set of consecutive sub-fields following the first set of sub-fields.

24. The method of claim 22, wherein the previous gray level is a gray level that comes immediately before the specific gray level and the next gray level is a gray level that comes immediately after the specific gray level.

* * * * *